United States Patent [19]

Takeuchi et al.

[11] Patent Number: 4,703,691

[45] Date of Patent: Nov. 3, 1987

[54] METHOD FOR ADJUSTING AN INK FOUNTAIN IN A PRINTING PRESS AND INK FOUNTAINS

[75] Inventors: Hideo Takeuchi, Shiroi; Michiaki Kobayashi, Kitamoto; Makoto Shibasaki, Tokyo, all of Japan

[73] Assignee: Dai Nippon Insatsu Kabushiki Kaisha, Tokyo, Japan

[21] Appl. No.: 859,307

[22] Filed: May 5, 1986

Related U.S. Application Data

[62] Division of Ser. No. 561,993, Nov. 16, 1983.

[30] Foreign Application Priority Data

| | | | |
|---|---|---|---|
| Dec. 21, 1982 | [JP] | Japan | 57-224620 |
| Aug. 31, 1983 | [JP] | Japan | 58-160135 |
| Aug. 31, 1983 | [JP] | Japan | 58-160134 |
| Aug. 31, 1983 | [JP] | Japan | 58-134845 |

[51] Int. Cl.[4] ..... B41F 31/04

[52] U.S. Cl. ..... 101/365

[58] Field of Search ..... 101/350, 365, 363, DIG. 24, 101/157, 169; 340/700, 703, 713, 716, 718, 753, 766, 767, 784, 825.06, 825.1; 137/551, 552, 554, 556.3

[56] References Cited

U.S. PATENT DOCUMENTS

| | | | |
|---|---|---|---|
| 3,347,161 | 10/1967 | Lenk et al. | 101/DIG. 12 |
| 3,623,430 | 11/1971 | Lessun | 101/365 |
| 3,930,447 | 1/1976 | Murray | 101/365 |
| 4,213,390 | 7/1980 | Liebert et al. | 101/365 |

FOREIGN PATENT DOCUMENTS

| | | | |
|---|---|---|---|
| 2830085 | 1/1980 | Fed. Rep. of Germany | 101/365 |

*Primary Examiner*—J. Reed Fisher

*Attorney, Agent, or Firm*—Stevens, Davis, Miller & Mosher

[57] ABSTRACT

An ink fountain has at least one position display means for displaying the position of each ductor blade piece to be preset before printing and at least one position indicating means for indicating an actual position of the blade piece. A gap between the distal end of the blade piece and the surface of an ink fountain roller is adjusted in such a manner that the actual position of the blade piece is registered with the position, to be preset, of the blade piece by operating an adjusting member.

3 Claims, 31 Drawing Figures

METHOD FOR ADJUSTING AN INK FOUNTAIN IN A PRINTING PRESS AND INK FOUNTAINS

This is a division of application Ser. No. 561,993, filed Nov. 16, 1983.

BACKGROUND OF THE INVENTION

This invention relates to a method for adjusting an ink fountain in a printing press before the printing operation and to the ink fountain itself.

In general, an ink fountain has a ductor blade which is divided into a plurality of pieces or regions. The ductor blade is disposed obliquely along an ink fountain roller or duct roller so as to form a wedgelike space as viewed in the lateral direction of the ink fountain. In the wedge-like space, ink for printing is stored and a certain amount of ink is fed therefrom to an inking arrangement through a gap between the distal end of the ductor blade and the surface of the duct roller.

Such an ink fountain is disclosed in U.S. Pat. No. 4,344,360, in which when an operator adjusts the ink gap before the printing operation, he operates adjusting screws to move the distal end of a ductor blade toward and away from the surface of a duct roller on the basis of data which are obtained from the rates of pattern areas on a printing plate, a film original or the like. The rates of pattern areas can be obtained by a pattern area measuring apparatus which detects the rate or proportion of the area occupied by a color to be printed in a predetermined region on the printing plate, the film original or the like.

That is, the operator operates the adjusting screws while observing a card on which the data of rates of pattern areas are written. However, there are many adjusting screws and the operator must pick up a datum corresponding to each adjusting screw to be adjusted from the card. Accordingly, there is a possibility that the operator might pick up a wrong datum therefrom.

In addition to this type of ink fountain, there has appeared an ink fountain which can automatically adjust the adjusting screws. In this new type of ink fountain, a drive motor is connected to each of the adjusting screws and is remote-controlled on the basis of data of rates of pattern areas. This mode of adjustment affords a remarkably short adjusting time. However, in this mode of adjustment, there must be provided many drive motors whose number corresponds to that of adjusting screws. In addition, a controller for controlling each of the drive motors is needed. Accordingly, this adjusting mode cannot be adapted easily to conventional ink fountains. If it were to be adapted to conventional ink fountains, it would require a great change in the construction of the fountains.

SUMMARY OF THE INVENTION

It is an object of this invention to provide a method for adjusting an ink fountain in a printing press before the printing operation by which the adjustment of the ink fountain can be easily and correctly carried out.

It is another object of this invention to provide a method for adjusting an ink fountain which is easily adapted to conventional ink fountains without a full-scale change of their construction.

It is still another object of this invention to provide an ink fountain wherein its adjustment can be carried out easily and correctly and its construction is simple.

According to one aspect of this invention, there is provided a method for adjusting an initial gap between a ductor blade divided into a plurality of regions or pieces and an ink fountain roller wherein the ductor blade is disposed along the ink fountain roller so as to form the gap between its distal end and the surface of the ink fountain roller, ink being fed through the gap toward an inking arrangement, the amount of ink to be fed being adjusted in a manner such that the distal end of each piece or region of the ductor blade is moved toward and away from the surface of the ink fountain roller by a corresponding adjusting member, said method comprising the step of: displaying electrically a position, to be preset or adjusted, of each adjusting member in the proximity thereof; and operating each adjusting member according to the displayed position for its adjustment.

According to another object of this invention, there is provided an ink fountain for feeding an amount of ink therefrom toward an inking arrangement through a gap between a ductor blade and an ink fountain roller wherein the ductor blade is divided into a plurality of pieces or regions, each of which is moved, at its distal end, toward and away from the surface of the ink fountain roller by a corresponding adjusting member operated manually thereby to adjust the gap, said ink fountain comprising: at least one position display means for displaying a position, to be preset before printing, of each piece or region, said position to be preset being calculated on the basis of a rate of pattern area detected from a printing plate, a film original, a proof or the like; and at least one position indicating means operating in connection with each adjusting member for indicating the actual position of each piece or region, said position indicating means being provided so as to form a pair together with said position display means.

Additional objects, advantageous effects and features of this invention will be best understood from the following description of specific embodiments thereof when read in conjunction with the accompanying drawings.

DETAILED DESCRIPTION OF THE INVENTION

Figure 1:
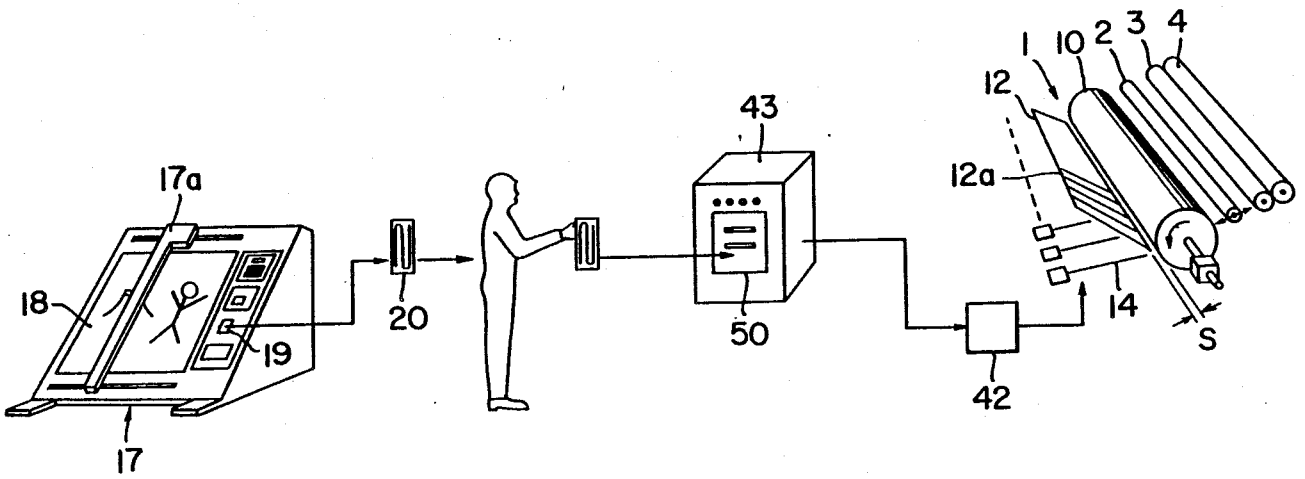
FIG. 1 is a schematic diagram indicating a process for adjusting an ink fountain.

FIG. 1 shows a process for adjusting the amount of ink which is fed from an ink fountain to an inking arrangement comprising a plurality of rollers 2, 3 and 4. The ink fountain 1 has an ink fountain roller or duct roller 10, a planar ductor blade or fountain blade 12 and a plurality of adjusting screws 14 for adjusting a gap S between the distal end of the ductor blade 12 and the surface of the duct roller 10. The ductor blade 12 is divided into a plurality of elongated pieces made of elastic material. However, the ductor blade 12 may be in the form of one continuous plate.

The ink for printing is stored in a wedge-like space formed between the ductor blade 12 and the surface of the duct roller 10 and is fed from the ink fountain 1 to the inking arrangement through the gap S when the roller 10 is rotated. The ink is fed finally to a printing plate (not shown) mounted on a plate cylinder (also not shown) in the case of an off-set printing press.

The density of ink on a printed matter, in general, depends on the amount of ink supplied onto the printing plate. The amount of supplied ink is adjusted by an operator by adjusting the gap S by turning adjusting screws 14. The data for the adjustment of each screw 14 is given to the operator through a process described below.

First, the rates of pattern areas on a printing plate 18 are measured by a pattern area measuring apparatus 17. The printing plate 18 is put on the table surface of the apparatus 17, and a measuring head 17*a* is moved over the printing plate 18 in order to measure the rates of pattern areas on the plate 18 with respect to a variety of colors to be printed. That is, the head 17*a* measures a rate or the amount of area a certain color occupys in a specific region on the plate 18 along the head 17*a*. Each specific region to be measured corresponds to a respective one ductor blade piece 12*a*.

The pattern area measuring apparatus is provided with a reading and writing device 19 for magnetic cards by which the data of pattern areas are recorded on the magnetic cards 20. In the case of four-color printing, four magnetic cards are prepared, corresponding to four colors.

The data of rates of pattern areas can be obtained from film originals, proof-sheets and the like in addition to the printing plates mentioned above.

Furthermore, the data of the rates of pattern area can be recorded on magnetic tapes, paper tapes, paper cards, semiconductor memory elements and the like in addition to the magnetic cards.

Each magnetic card is taken out of the pattern area measuring apparatus 17 and put into the input unit 50 of a controller 43. The signals of the controller 43 are transferred to each of adjusting units 25 described below through a multiplexer 42.

Figure 2:
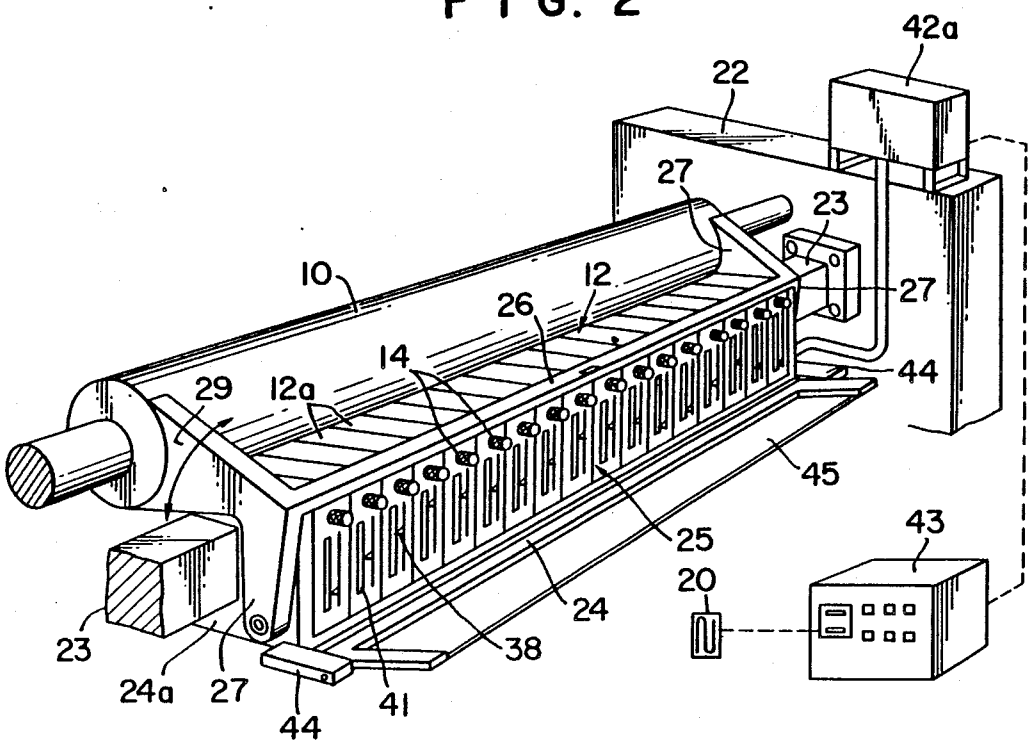
FIG. 2 is a perspective view of an ink fountain according to this invention.

FIG. 2 shows a perspective view of the ink fountain 1. The ink fountain roller 10 is rotatably supported between two frames 22 (only one frame 22 being shown in FIG. 2). The frames 22 also support a display box or adjusting box 24 via two rectangular arms 23, 23. The display box 24 has a plurality of the adjusting units 25, each of which corresponds to a respective one piece 20*a* of the ductor blade 12 and is in the form of a thin box. Furthermore, the adjusting units 25 are accommodated detachably in the display box 24 in the manner of books accommodated in a book-case.

To the side walls 24*a* of the display box are pivotably connected the legs 27, 27 of a blade supporting frame 26 on which the ductor blade 12 is supported.

Accordingly, the frame 26 can be separated from the roller 10 when the ink fountain is to be cleaned.

The details of the adjusting units 25 will now be described with reference to FIGS. 3 through 5.

Each adjusting unit 25 has a box-like casing 30 whose front face is open. In the casing 30 is provided a base plate 31 which supports a position display means 41 on its front wall. A front panel made of acryl resin or the like covers the open front face of the casing 30, and the adjusting screw 14 extends horizontally through the upper parts of the casing 30 and the panel 32. The adjusting screw 14 has a screw portion 14*a* engaged with an auxiliary member 30*a* fixed to the casing 30. The distal end of the screw 14 abuts against the vertical wall of a cam 33 which is pivotally supported by a pivot pin 33*a* on the casing 30. The projecting upper corner of the cam 30 abuts against the lower end of the ductor blade piece 12*a*. When the screw 14 is rotated to swing the cam 33 about the pivot 33*a*, the lower end of the piece 12*a* is moved upward and downward thereby to adjust the gap S.

Furthermore, in the lower part of the casing 30 is provided with a horizontal shaft 34 which rotatably supports a guide pulley 36 cooperating with a guide pulley 35 fixed to an intermediate part of the adjusting screw 14. Around the two guide pulleys 35 and 36 is passed a belt 37. A triangular indicator 38 is provided in a connecting position at which two ends of the belt 37 are connected to each other. The tension of the belt 37 is adjusted by a tension pulley 37*a* provided downward of the guide pulley 35.

The panel 32 has two parallel slits 39 and 40 extending vertically. The slit 39 is disposed in registration with the display means 41 so that an operator can see the means 41 through the slit 39. In the slit 40, the indicator 38 moves vertically.

The display means 41 has a plurality of small light emitting diode elements 41*a* disposed contiguously in a vertical row. One of the diode elements 41*a* emits light in accordance with a signal transmitted from the controller 43 through the multiplexer 42. That is, the gap S, to be preset, corresponding to each blade piece 12*a* is displayed through an element 41*a* emitting light. When the adjusting screw 14 is adjusted before printing so that the indicator 38 is registered with the diode element 41*a* emitting light at that time, the gap S corresponding to the blade piece to be adjusted can be set at a value in accordance with the rate of pattern area in the corresponding position of the printing plate.

As described above, the ink fountain 1 has a construction such that the display means 41 for displaying the width of the gap S to be set before printing is integrated with the indicating mechanism (position indicating means) comprising the indicator 38, pulleys 35 and 36 and belt 37 to form one compact unit 25 and that a plurality of such units 25 are detachably incorporated in the display box 24. Accordingly, the entire volume of the ink fountain can be prevented from becoming bulky. In addition, this compact construction can be adapted to almost all of the conventional ink fountains.

Moreover, as the adjusting screw 14 is provided in the upper portion of the casing 30 so as to directly swing the cam 33 abutting against the blade 12 thereby to make useless any motion transferring member between the cam 33 and the screw 14, the number of parts used in one unit 25 is decreased, and the construction of the unit 25 also becomes simple. In addition, as the display means 41 has a linear form, the operator can easily perceive the position where the indicator 38 is to be set. This construction of the display means 41 also makes the indicating mechanism simple because the indicator 38 is moved linearly along the linear display means 41.

Now referring back to FIG. 2, the lower part of the display box 25 is provided with a mirror 45 in which the front face of the box 25 is reflected. The mirror 45 is swingably supported by two brackets 44 and 44 fixed to opposite side ends of the box 25. The mirror 45 functions to help the operator perceive the positions of the diode elements emitting light and the indicators 38 to be registered therewith. If the ink fountain without such a mirror is located at a low level, the operator must bend his body to see the front face of the box 25. However, even in this case, if the mirror 25 is provided, the operator can adjust the screws 14 with the aid of the mirror 45 without bending his body. Accordingly, even if the ink fountain is located in a lower or narrow position, the operator can adjust the screws 14 while assuming a natural posture. After the screws 14 have been adjusted the mirror 45 is swung upward to the front face of the box 24.

An electric control for displaying the position of the indicator 38 of each unit 25 to be set will now be described.

Figure 6:
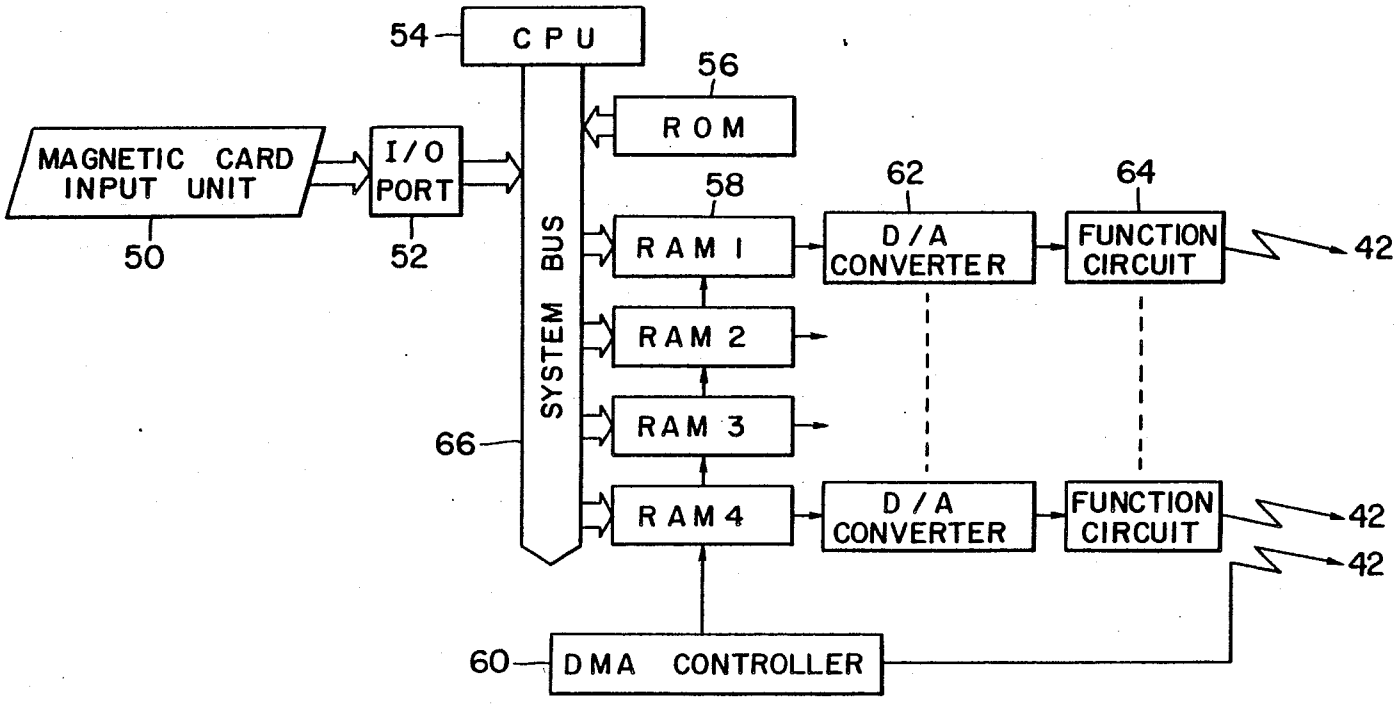
FIG. 6 is a block diagram showing the control system of a controller.

The controller 43, as shown in FIG. 6, has a magnetic card input unit 50, an input-output port (I/0 port) 52, a central processing unit (CPU) 54, a system bus 66, a read-only memory (ROM) 56, a plurality of random access memories (RAM) 58 each corresponding to a respective one of adjusting units 25, a direct memory access controller (DMA controller) 60 operating each RAM 58 at the command of the CPU 54, a plurality of digital-to-analog converters (D/A converters) 62 each coupled to a respective one of the RAMS 58 in order to convert an output from each RAM 58 into an analogous signal, and a plurality of function circuits 64 each coupled to a respective one of the D/A converters 62.

Figure 7:
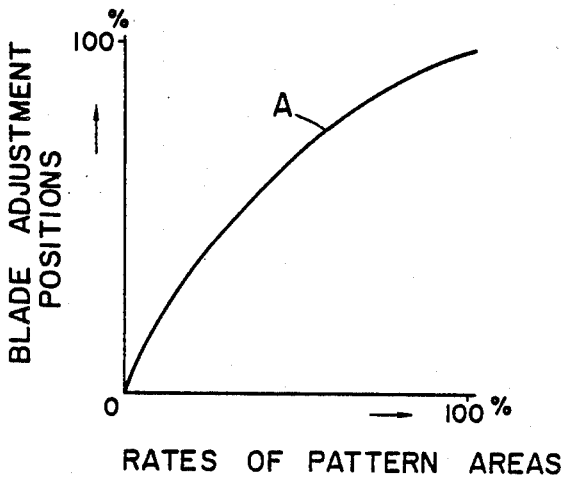
FIG. 7 is a graph indicating the relationship between the rates of pattern areas and the positions of ductor blade pieces to be preset.

When the magnetic card 20 is placed into the magnetic card input unit 50, the data in the card 20 is read by a magnetic head (not shown) provided therein to be memorized by each RAM 58 through the CPU 54. After all magnetic cards 20 (four cards in case of four color printing) have been read, the CPU 54 sends a start signal to the DMA controller 60. The DMA controller 60 thereupon begins to designate addresses so that the data at the designated addresses are produced by the corresponding RAMS 58 to be respectively converted into analogous signals by the corresponding D/A converters 62. These analogous signals are put into the respective function circuits 64 in which the analogous signals corresponding to the rates of pattern areas are respectively converted into signals of the positions of the indicators 38 of the respective units 25 to be set through a functional curved line A as shown in FIG. 7. The abscissa, in FIG. 7, indicates the rates of pattern areas, and the ordinate indicates the positions of blade pieces 12*a* to be adjusted, that is, the positions of the indicators 38 to be set.

Figure 8:
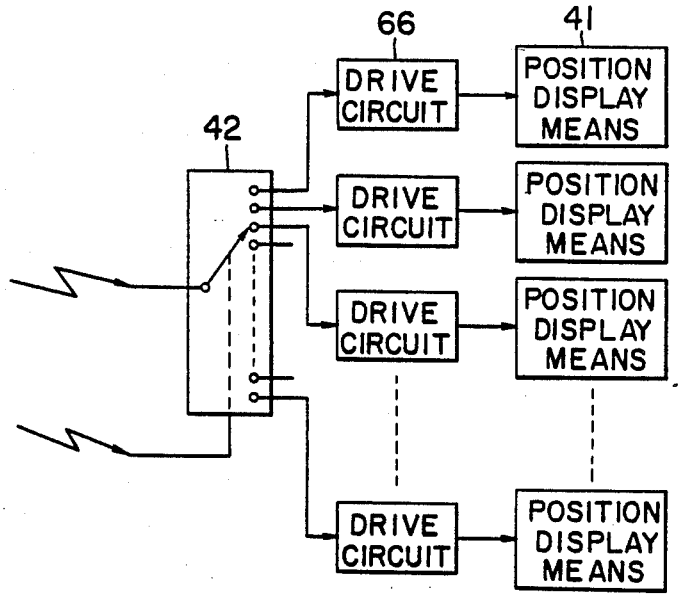
FIG. 8 is a block diagram of the control system of a controller which is connected to the control system illustrated in FIG. 6.

The signal from each function circuit 64 is then put into a corresponding drive circuit 66 (FIG. 8) through the multiplexer 42 which is operated by the controller 60. The multiplexer 42 and a plurality of drive circuits 66 are accommodated in a box 42*a* mounted on the upper surface of one of the frames 22 and 22 (FIG. 2). The multiplexer 42 comprises only semiconductors without any mechanical motions and its switching operation is controlled by electric signals from the DMA controller 60. Each drive circuit 66 sends a signal to the display means 41 of the corresponding adjusting unit 25 so that one diode element 41*a*, of the display means 41, disposed in a position corresponding to the signal, emits light. If the corresponding indicator 38 is so adjusted as to be registered with the diode element 41 emitting light at that time, the distal end of the blade piece 12*a* is preset thereby to define the gap S corresponding to a rate of pattern area.

Instead of the light emitting diodes, liquid crystals, incandescent lamps, plasma displays or neon lamps may be used.

To adjust the gap S correctly, it is necessary that the reference or zero position of each indicator 38 correspond to that of the respective blade piece 12*a*. That is, for example, when a blade piece 12*a* abuts against the surface of the ink fountain roller 10 (its gap S is zero), the indicator 38 corresponding to the piece 12*a* must be disposed in the same position in height as the lowest element 41*a* of the display means 41.

Figure 9:
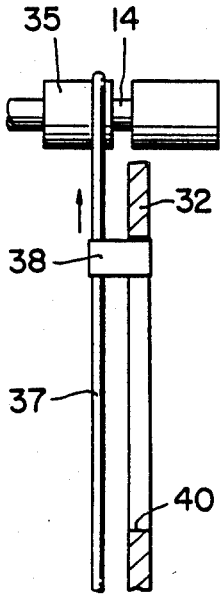
FIG. 9 is an elevation in vertical section of the front part of the adjusting unit as shown in FIGS. 3, 4 and 5.

In the case wherein the two reference positions do not correspond to each other, the relative position of the indicator 30 with respect to the rotation of the adjusting screw 14 is corrected as shown in FIG. 9. That is, if the adjusting screw 14 is forcibly rotated in a state wherein the indicator 38 is engaged with either the upper or lower edge of the slit 40 to cause the belt 37 to slip on the two pulleys 35 and 36, the relative relationship between the position of the indicator 38 and the rotation of the screw 14 can be easily changed.

The construction of the adjusting mechanism for adjusting the gap S is not limited to the above example and any of a variety of other adjusting mechanisms may be employed.

Figure 11:
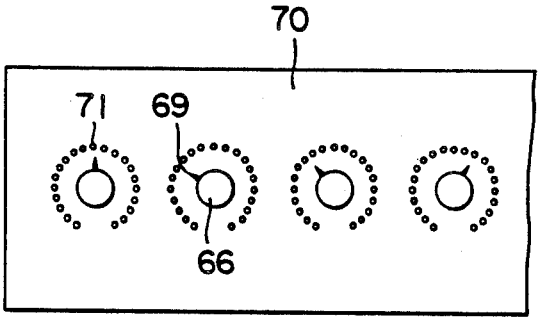
FIG. 11 is a front view of a front panel of the ink fountain shown in FIG. 10.
Figure 10:
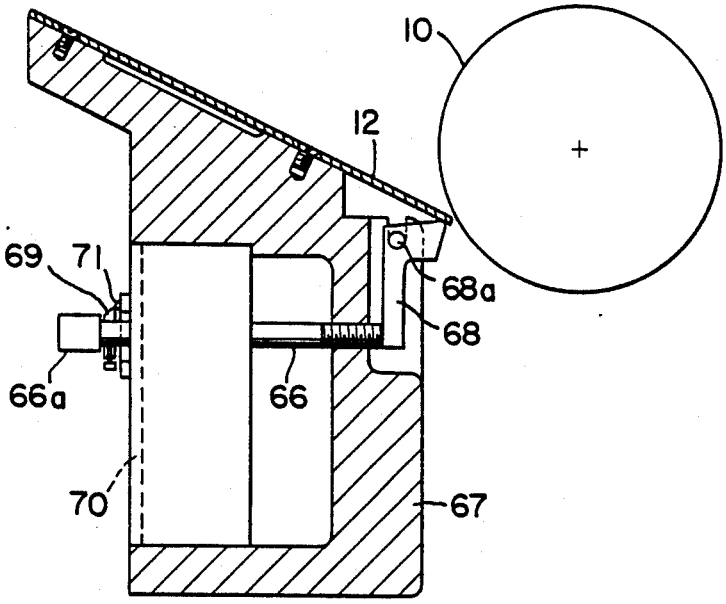
FIG. 10 is a side elevation in vertical section of a display box in connection with a position display means and a position indicating means in another example of an ink fountain.

In FIGS. 10 and 11, a display box 67 is provided with a plurality of adjusting screws 66 which are disposed at certain intervals in its lateral direction. In this ink fountain, the ductor blade 12 is directly mounted on the inclined top surface of the display box 67. Each adjusting screw 66 is provided in the upper part of the box 67 so as to swing an L-shaped cam 68 about a pin 68*a*. The box 67 is elongated in the lateral direction along the ink fountain roller 10. The front face of the box 67 is covered with a front panel 70 through which the adjusting screw 66 projects outward. The projecting end of the adjusting screw 66 is provided with a knob 66*a*. A position display means 71 is so disposed on the front panel 70 as to surround the adjusting screw 66 as shown in FIG. 11.

Figure 12:
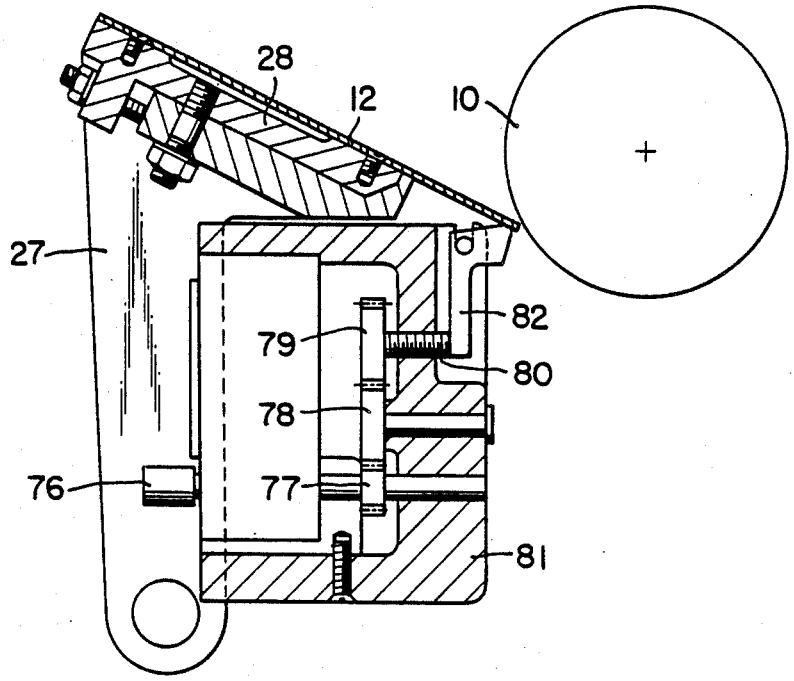
FIG. 12 is a side elevation in vertical section of a display box in still another example.

In FIG. 12, the motion of each of the adjusting screws 66 provided in the lower part of a display box 81 is transmitted to an operating screw 80 which contacts a cam 82 through three gears 77, 78 and 79. The operating screw 80 may be directly engaged with the blade 12 without the interposition of the cam 82.

Figure 13:
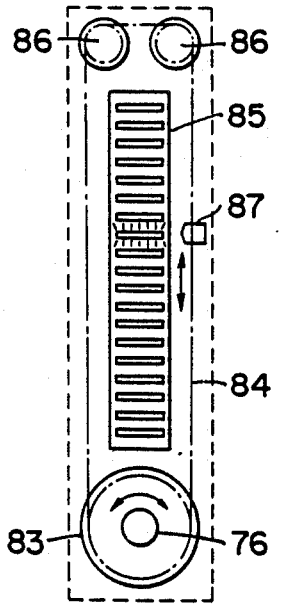
FIG. 13 is a front view showing a part of the front panel of the display box as shown in FIG. 12.

FIG. 13 shows one indicating mechanism incorporated in the display box 81. To the adjusting screw 76 is fixed a pulley 83 which moves a belt 84 having an indicator 87. The belt 84 is guided by two guide pulleys 86 and 86 provided in the upper part of the display box 81 so as to travel along a display means 85.

Figure 14:
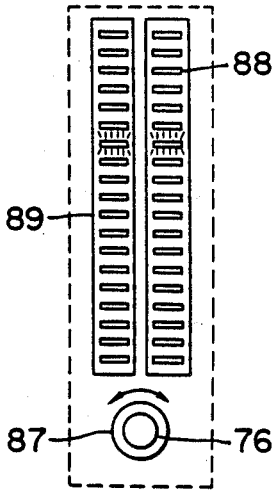
FIG. 14 is another front view showing a part of the front panel of the display box shown in FIG. 12.

Instead, an indicating mechanism as shown in FIG. 14 can be used. That is, the adjusting screw 76 is provided with a variable resistor 87. A position indicating means 88 is disposed parallel to a position display means 89. These two means have the same construction as the display means 85 as shown in FIG. 13. The adjusting screw 76 is so adjusted that the two means 88 and 89 emit light at the same level in height.

Figure 15:
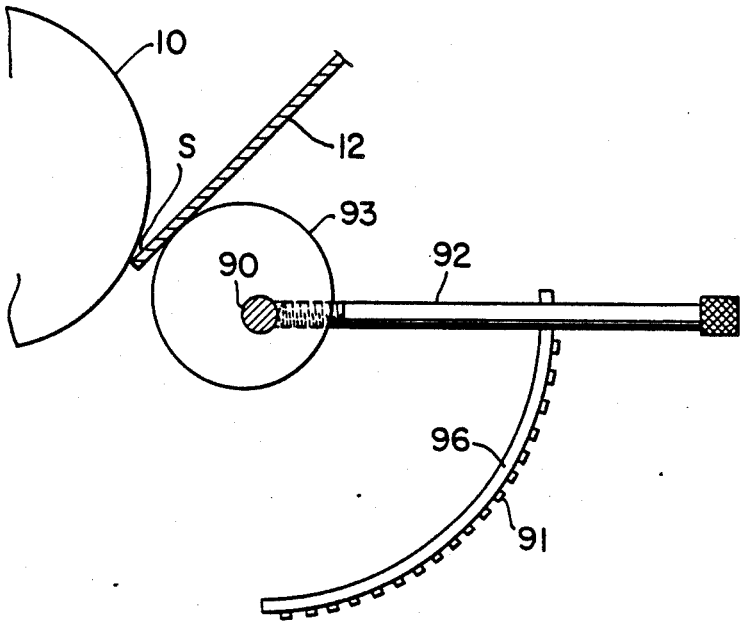
FIG. 15 is a partial side elevation in vertical section of a display box in a further example.
Figure 16:
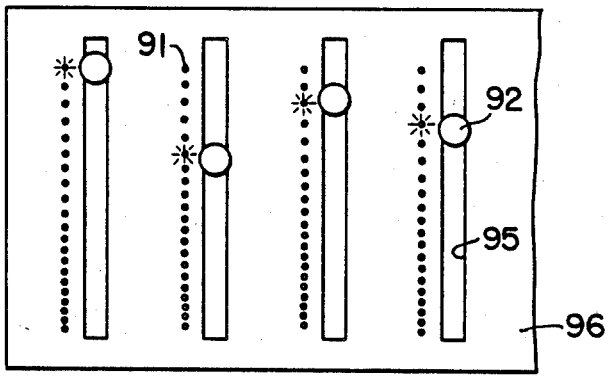
FIG. 16 is a front view of the display box shown in FIG. 15.

FIGS. 15 and 16 show an additional example of a blade adjusting mechanism. Along the fountain roller 10 is extended a supporting bar 90 which rotatably supports a plurality of eccentric round cams at certain intervals of distance. Each cam 93 is rotated by a lever 92 whose end is inserted into the cam 93. The lever 92 is moved along one of linear slits 95 which are provided parallel to each other in an arcuate plate 96. Along each slit 95 is disposed a position display means 91 which is composed of a plurality of light emitting diode element. The gap S is adjusted in such a manner that each cam 93 is rotated by swinging its lever 92.

Figure 17:
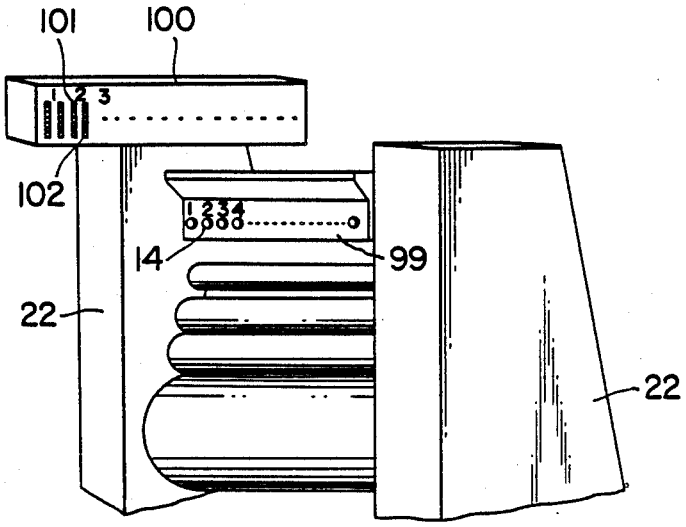
FIG. 17 is a perspective view of an ink fountain in an additional example.
Figure 18:
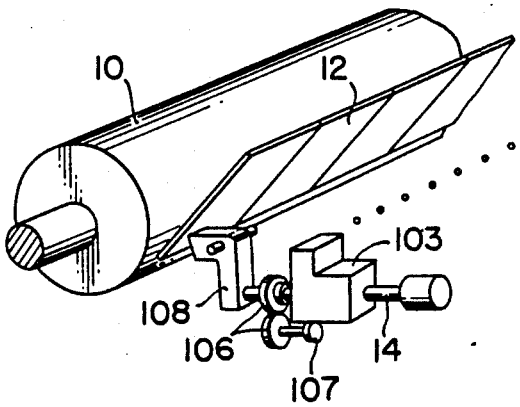
FIG. 18 is a perspective view showing details of the adjusting mechanism in the ink fountain shown in FIG. 17.

In FIG. 17, on the top of one of the frames 22, 22 is provided a display box 100 which has a plurality of display units each comprising a position display means 101 and a position indicating means 102. Each unit corresponds to a respective blade piece 12*a*, and the position display means 101 and the position indicating means 102 are similar to the position display means 89 and the position indicating means 88, as shown in FIG. 14, respectively. Between the two frames 22, 22 is provided an adjusting box 99 in which a plurality of the adjusting screws 14 are disposed horizontally at certain space intervals. Each of adjusting screws 14, as shown in FIG. 18, is rotatably supported by a block 103 and the end of the screw 14 abuts against a cam 108. The screw 14 is connected to a potentiometer 107 through two gears 106 and 106. The potentiometer 107 is coupled to the corresponding one of the position indicating means 102.

The apparatus as shown in FIG. 17 is operated in the following manner.

Figure 19:
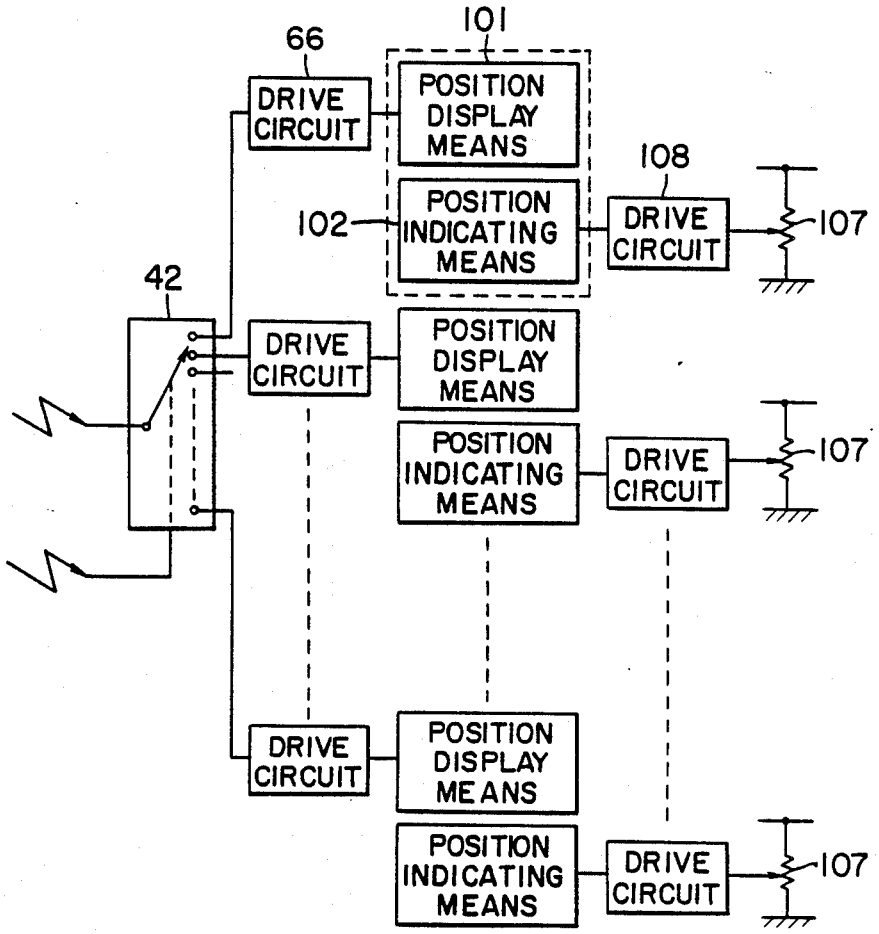
FIG. 19 is a block diagram of a control system in the ink fountain shown in FIG. 17.

In FIG. 19, each of the display means 101 displays a position, to be preset, of a respective blade piece 12*a* in the manner described above. At the same time, each of the indicating means 102 dispalys an actual position of its respective blade piece. When the gap S is adjusted, each adjusting screw 14 is so rotated that the two means 110 and 112 emit light at the same level in height as shown in FIG. 14.

The display box 100 may be fixed to a wall which is located in a position clearly visible to the operator. Furthermore, a belt and a pulley can be used instead of the gears 106 and 106.

Figure 20:
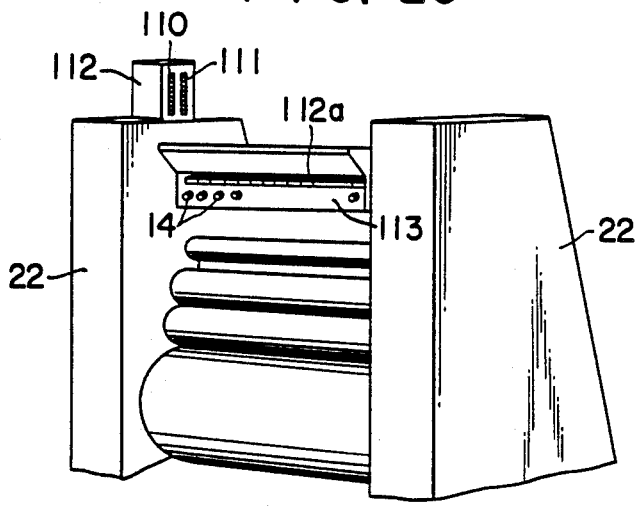
FIG. 20 is a perspective view of an ink fountain in still another example.
Figure 21:
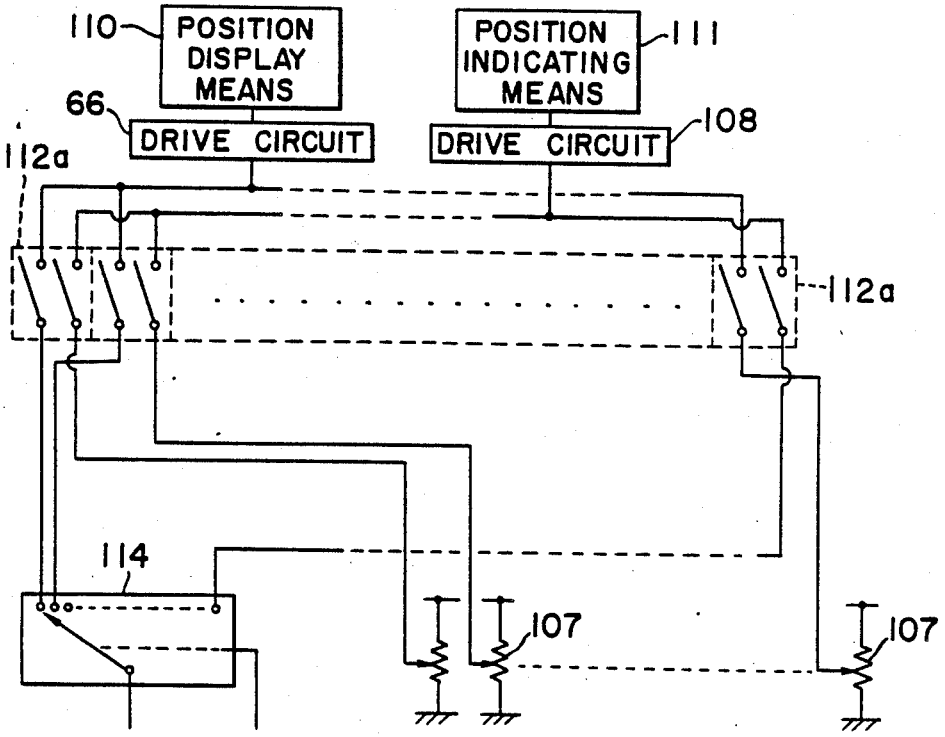
FIG. 21 is a block diagram of a control system in the ink fountain shown in FIG. 20.

FIGS. 20 and 21 show an example similar to that shown in FIGS. 18 and 19.

On the top of one of the frames 22, 22 is mounted a display box 112 on which only one display unit similar to that of FIG. 17 is provided. The display unit has a position display means 110 and a position indicating means 111. An adjusting box 113 is provided with the screws 14 and a plurality of circuit changing switches 112 whose number is the same as that of the screws 14. Each of the switches 112*a* is provided for changing its circuit to display on the box 112 the two positions of a blade piece 12*a* which the operator wishes to adjust.

When the operator pushes one of the switches 112*a*, the display box 112 can dispaly the two positions of a blade piece 12*a* to be adjusted through an analog switch 114, drive circuits 66 and 108, and the corresponding one of potentiometers 107.

Figure 4:
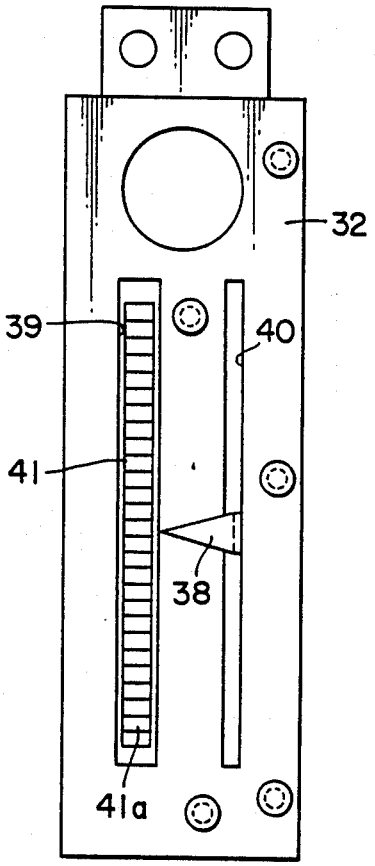
FIG. 4 is a front elevation of the adjusting unit shown in FIG. 3.
Figure 5:
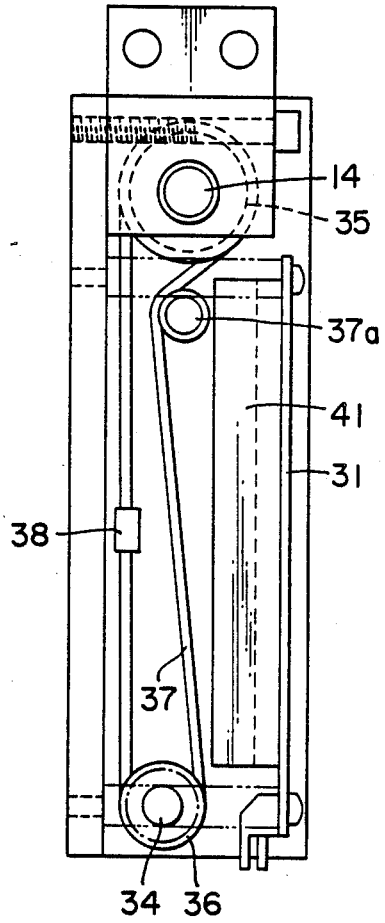
FIG. 5 is a side elevation of the inside of the adjusting unit in a state wherein its casing is eliminated.
Figure 22:
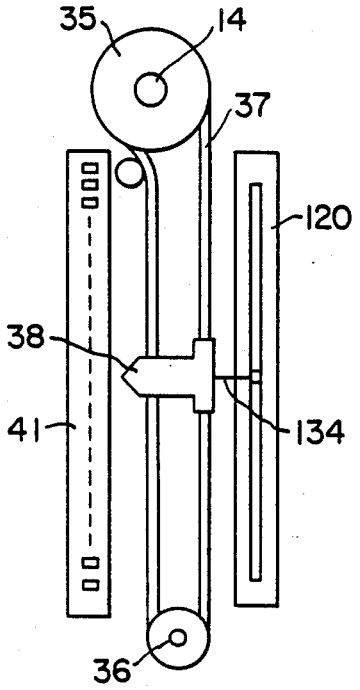
FIG. 22 is a front view of an adjusting unit in another example in which a potentiometer is provided.

FIG. 22 shows another example of an adjusting unit similar to that of FIGS. 4 and 5. A potentiometer 120 is provided along the belt 37 and an actuator 134 is fixed to the indicator 38. When the screw 14 is rotated, the actuator is moved together with the indicator 38. During a printing operation after the gap S has been adjusted, there are cases wherein it is necessary to readjust some blade pieces for some reason. This slight adjustment of each blade piece which has been readjusted is recorded on a magnetic card through the potentiometer 120. These memorized data are utilized when the operator adjusts the ductor blade 12 next time.

In the above embodiments of the invention, the data of the magnetic card 20 are automatically displayed on the position display means. However, the above indicating mechanisms can be adapted to an adjusting unit without the above position display means 41, 85, 89 or 91.

Figure 3:
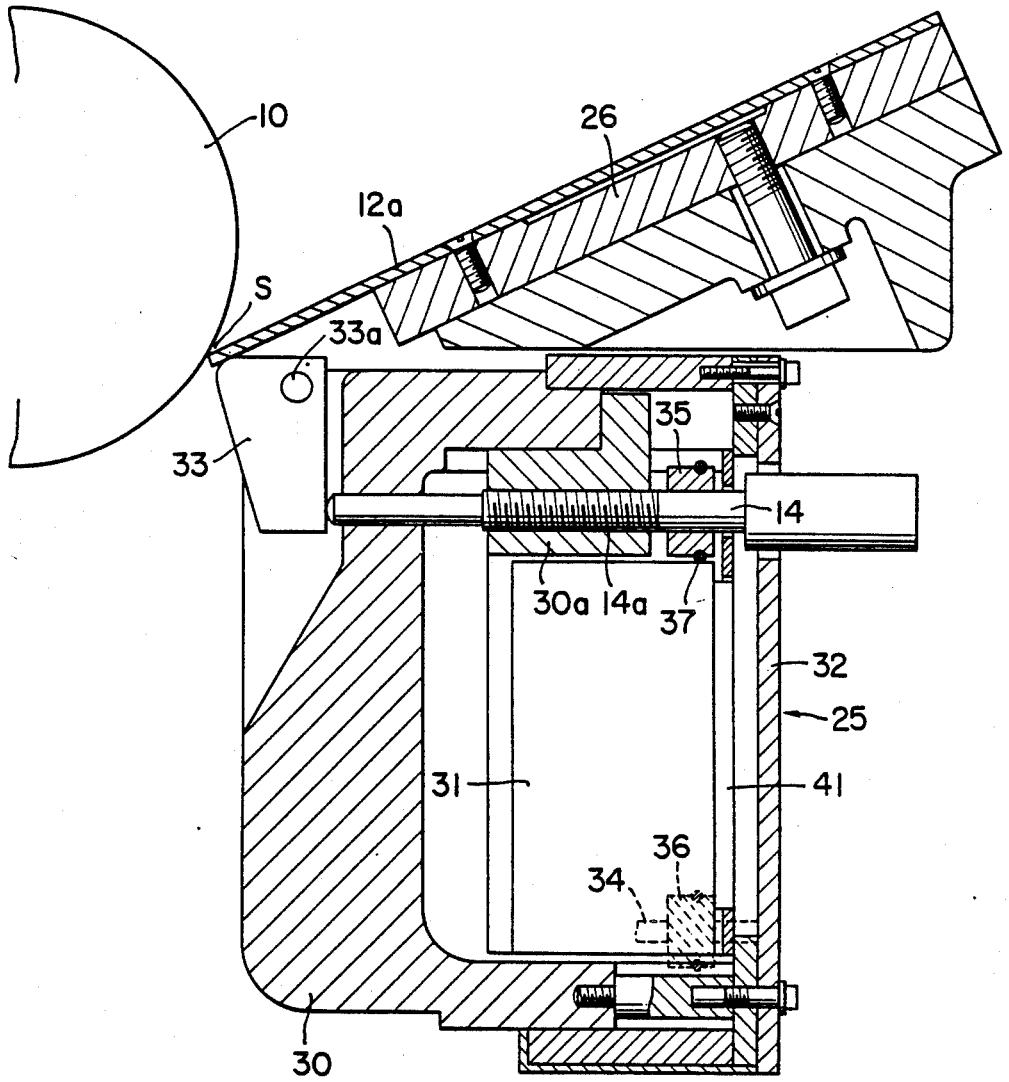
FIG. 3 is a side elevation in vertical section of an adjusting unit which is detachably accommodated in a display box of the ink fountain.
Figure 23:
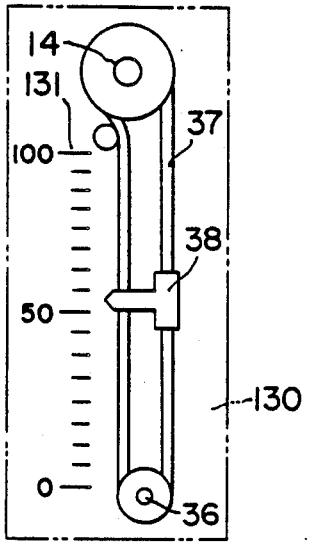
FIG. 23 is a front view of an adjusting unit in an example different from those mentioned above.

That is, the above indicating mechanisms (mechanical means for the position indicating means) as shown in FIGS. 3, 4 and 5 can be adapted to an adjusting unit as shown in FIG. 23 in which a scale 131 comprising a plurality of short calibration lines is provided. In the case of this unit, the data for adjustment are indicated on a paper card or the like. The data are drawn up on the basis of the rates of pattern areas in the above manner. The operator adjusts each screw 14 while observing the data on the paper or the like.

Figure 24:
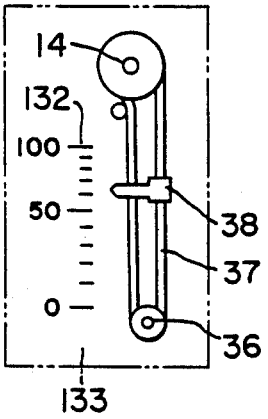
FIG. 24 is a front view of an adjusting unit similar to that shown in FIG. 23.
Figure 25:
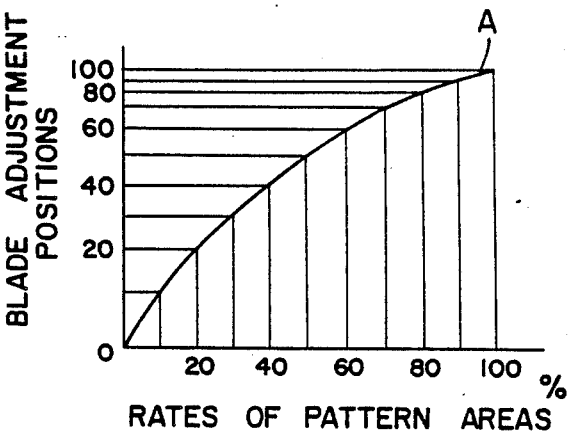
FIG. 25 is a graph similar to that of FIG. 7 for converting the rates of pattern areas into the positions of blade pieces to be preset.

In FIG. 23, the scale 131 is formed with a plurality of short calibration lines which are disposed at equal intervals of distance. However, in FIG. 24, a special scale 132 is provided. The positions of blade adjustment are so determined that the rates of pattern areas are converted through the functional curved line, as shown in FIG. 25. The thus determined positions are marked on a front panel 133 to form the scale 132.

FIGS. 26 through 31 show other examples of control systems in the controller 43.

Figure 26:
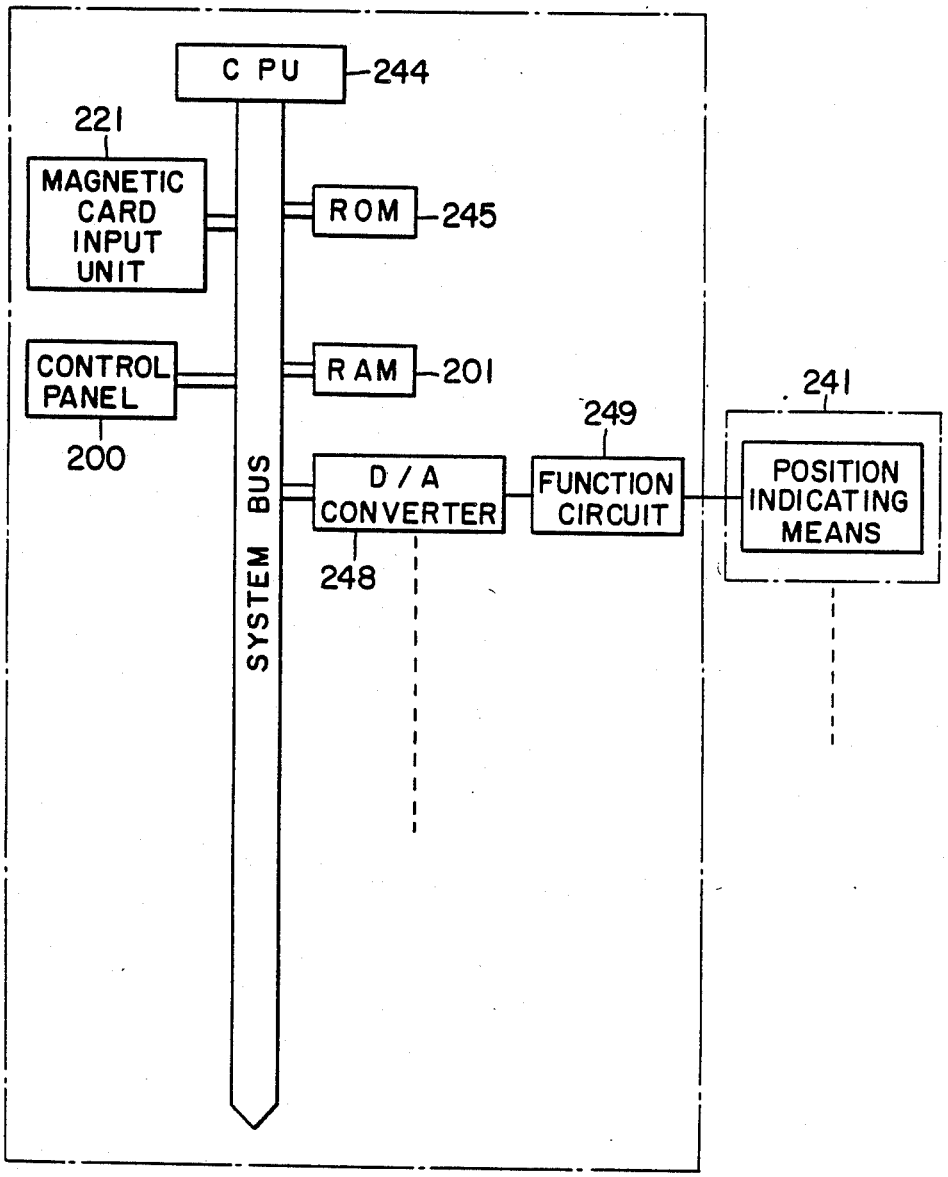
FIG. 26 is a block diagram of another electric control system.

The control system shown in FIG. 26 has a magnetic card input unit 221 for reading a magnetic card on which data concerning the rates of pattern areas are recorded, a control panel 200 for commanding the unit 221 to start reading the magnetic card, a CPU 244, a ROM 245, a sole RAM 201, a plurality of D/A converters 248 whose number corresponds to that of ductor blade pieces 12*a*, a plurality of function circuits 249 each connected to a respective D/A converter 248 and a plurality of position indicating means 241 each connected to a respective function circuit 249.

The operation of the control system shown in FIG. 26 will be described with reference to FIG. 27.

First, power is turned on (S1), and a magnetic card reading switch is turned on (S2). Then, the unit 221 reads the data on the magnetic card inserted thereinto to write the data in the RAM 201 (S3). Thereafter, the CPU converts the data of 3 bytes into those of 1 byte on the basis of a program in the ROM 245, and the data of 1 byte is, then, memorized in the RAM 201 again (S4). This operation is carried out with respect to the remaining magnetic cards for other colors (S5). Then, a display switch is turned on (S6) so that each D/A converter 248 reads one of the data in the RAM 201 (S7) and then converts it into an analog signal for a respective function circuit 249 (S8). The function circuit 249 converts the analog signal into a positional signal of the blade piece 12*a* (S9), and then transmits the positional signal to a corresponding position indicating means 241(S10) whereby a position, to be preset, of each blade piece 12*a* is displayed in each means 241. When the display switch is turned off, each position display means 241 stops its operation.

Figure 27:
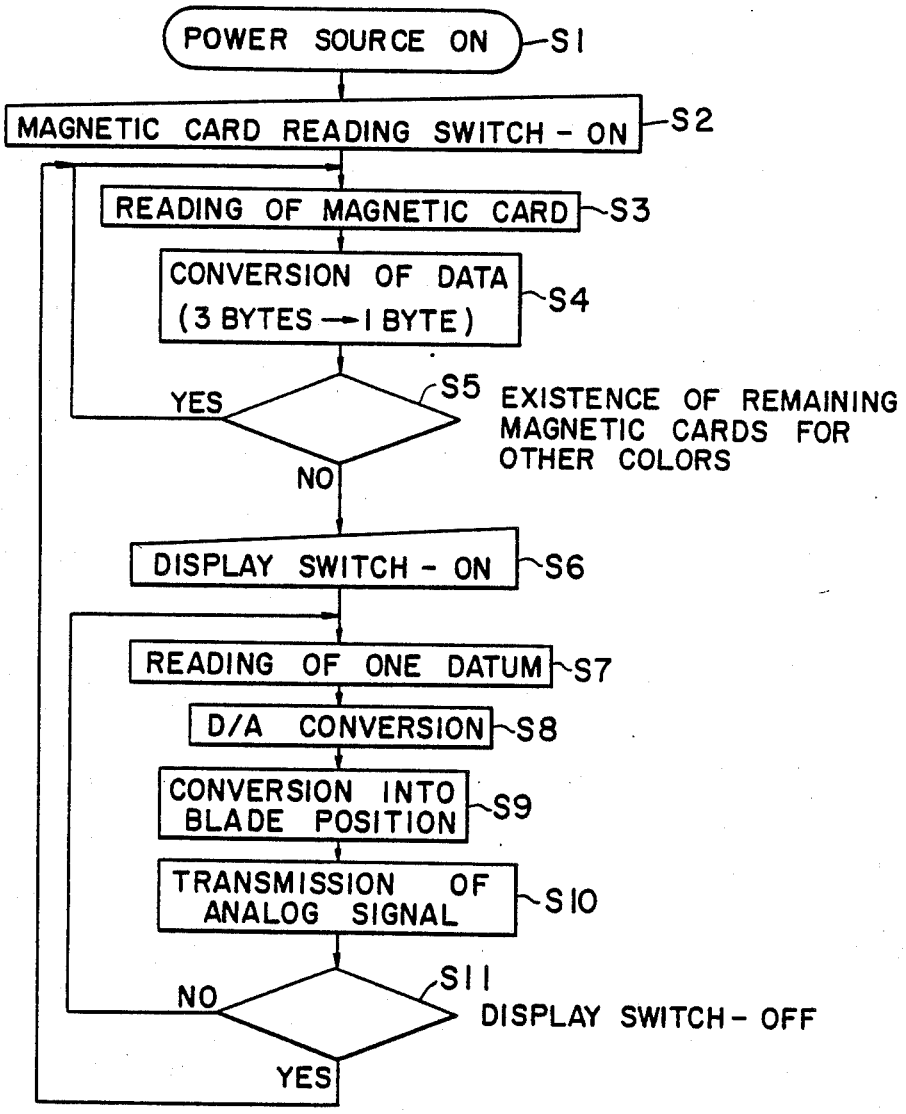
FIG. 27 is a flow chart of the operation of the control system shown in FIG. 26.
Figure 28:
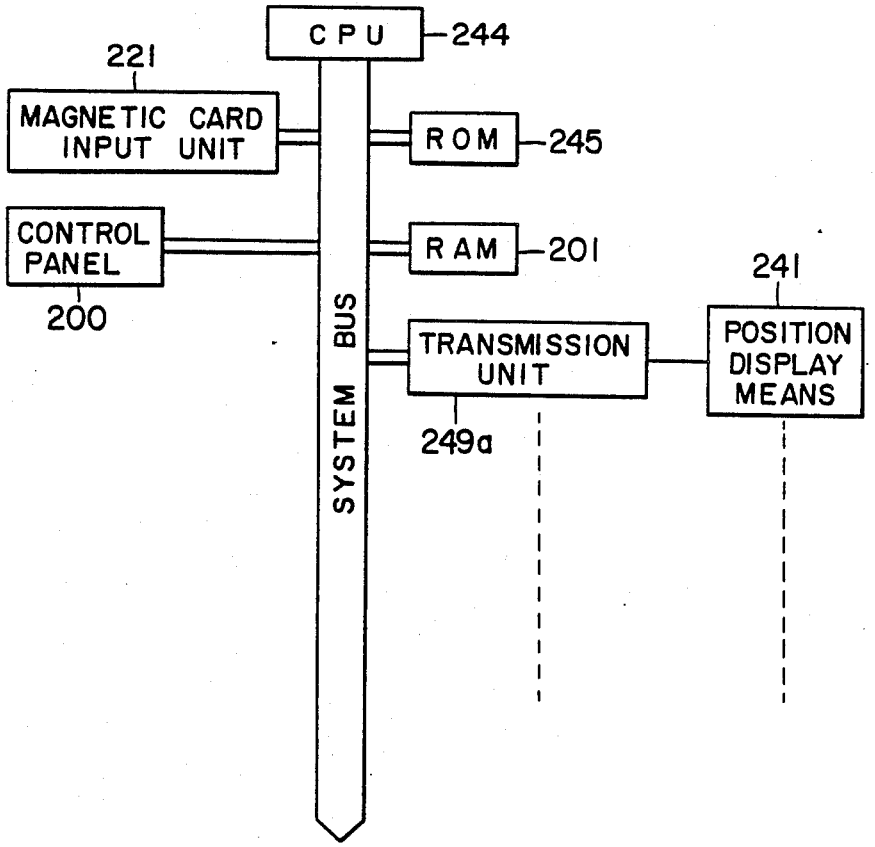
FIGS. 28 through 31 are block diagrams of other electric control systems.

In FIG. 27, instead of the converters 248 and the function circuits 249, a plurality of transmission units 249*a* are used. This system is adapted to a case wherein digital signals are transmitted to the position display means 241. In the systems shown in both FIGS. 26 and 28, the analog or digital signals are transmitted parallelly to the position display means 241.

Figure 29:
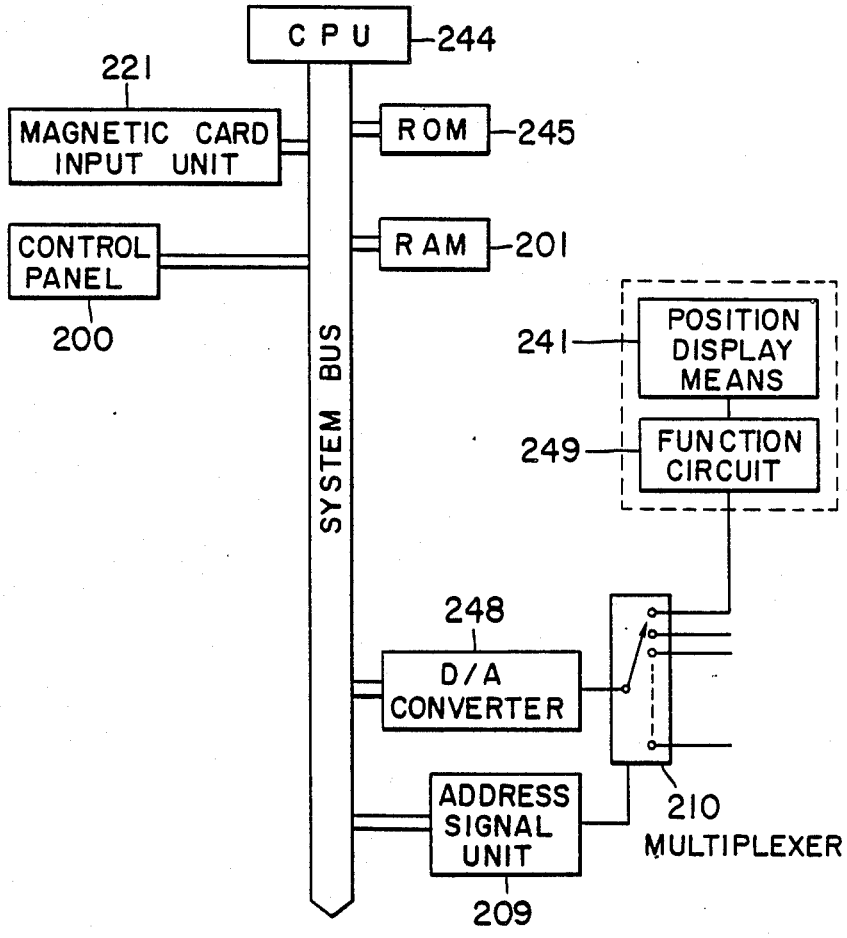
Figure 30:
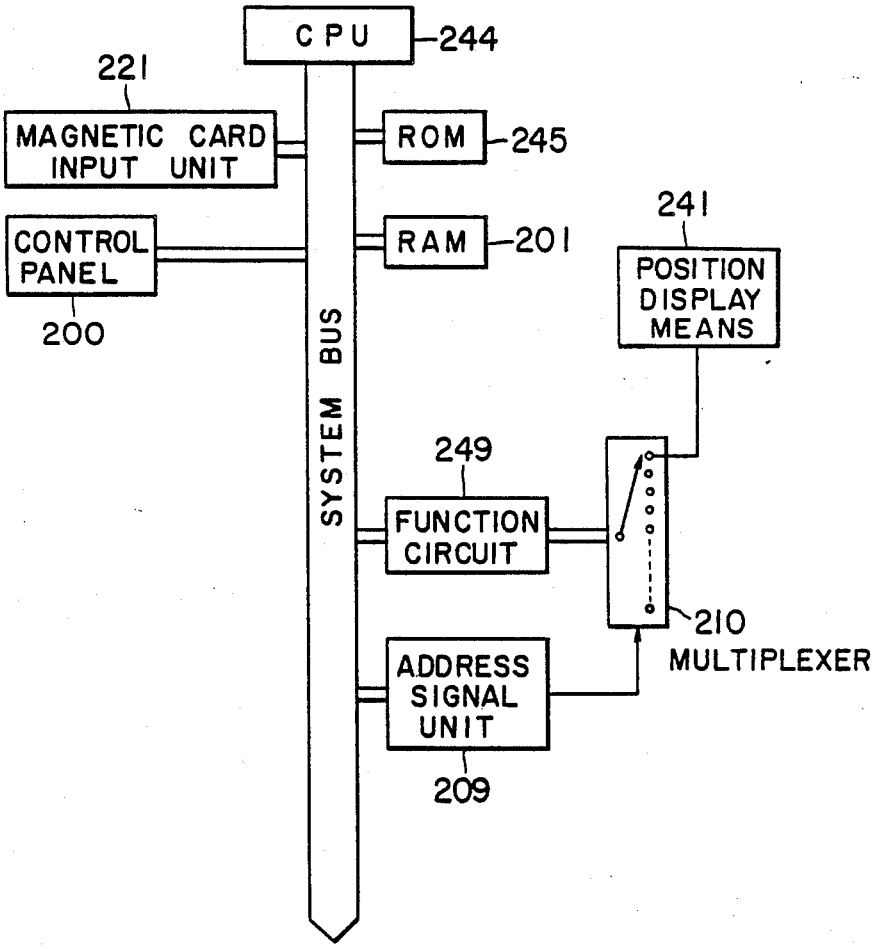
Figure 31:
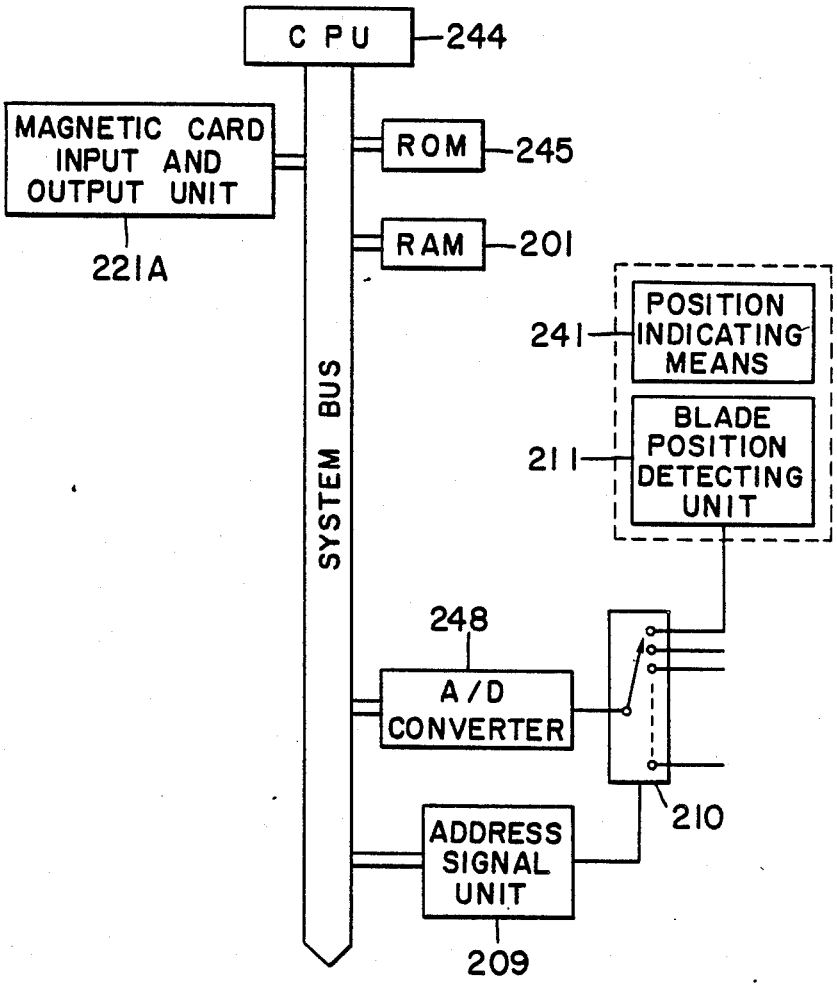

FIGS. 29 through 31 show two systems in which signal transmission is carried out through a time-sharing system.

In FIG. 29, a single D/A converter 248 and an address signal unit 209 are respectively connected to the system bus. The unit 209 operates a multiplexer 210 coupled to the D/A converter 248 and each of terminals of the multiplexer 210 is coupled to a respective one of units comprising one function circuit 249 and one position display means 241. The system shown in FIG. 29 is adapted to a case wherein the analog signals are transmitted to each position display means 241. However, in the case of digital signal transmission, a function circuit 249 is substituted for the D/A converter 248. If the multiplexer 210 is fitted near the ink fountain in these systems, the number of transmission lines disposed between the controller 43 and the position display means 241 can be decreased. Furthermore, if a plurality of circuit changing switches similar to those shown in FIG. 21 are provided, the number of the position dispaly means 241 can be decreased.

FIG. 31 shows a control system in which a slight adjustment of each blade piece 12*a* carried out during the printing operation can be recorded on a magnetic card. For this purpose, a magnetic card input and output unit 221A is coupled to the system bus and a respective one of blade position detecting units 211 is disposed along a corresponding position indicating means 241. Each blade position detecting unit 211 is like the potentiometer 120 shown in FIG. 22. A signal detected by the detecting unit 211 is transmitted to the magnetic card input and output unit 221A to be recorded on a magnetic card through the multiplexer 210, A/D converter 248 and system bus. The data of the blade adjustment after each blade piece being preset are useful when the same patterns are printed as before.

What we claim is:

1. An ink fountain for feeding ink toward an inking mechanism through a gap between a ductor blade and an ink fountain roller, wherein the ductor blade is divided into a plurality of regions, each region of said ductor blade being movable at its distal end toward and away from a surface of the ink fountain roller to adjust said gap by a corresponding adjusting member, said ink fountain comprising:

(a) a display box adjacent the ductor blade; and (b) a plurality of detachable adjusting units detachably disposed in the display box, each adjusting unit corresponding to a respective said region of the ductor blade, each adjusting unit having (i) an adjusting member including a rotatable knob for adjusting a position of the ductor blade, (ii) a position display means for displaying a preset position at which the respective region of the ductor blade is to be positioned by said adjusting member, said preset position being preset before printing and before adjustment of a position of the ductor blade by said adjusting member, the preset position being determined based on a rate of pattern area detected from a pattern bearing material, and (iii) a position indicating means formed on said knob of the adjusting member for indicating the actual position at which each respective region of said ductor blade is positioned by the respective adjusting member, said position display means, said adjusting member and said position indicating means being integrated with one another to form each detachable adjusting unit, said position display means having a plurality of display elements for displaying said preset position, said display elements being disposed in a circular row around the knob of the adjusting member such that a particular element in said circular row is actuated to indicate an angular position at which said rotatable knob is to be moved.

2. An ink fountain according to claim 1, further comprising a mirror fitted to the display box so that an operator can observe a condition of each position display means through the mirror to facilitate adjusting of each adjusting member.

3. An ink fountain according to claim 1, wherein said position display means comprises a plurality of light emitting elements.

* * * * *